US005906701A

United States Patent [19]

Smythe

[11] Patent Number: 5,906,701

[45] Date of Patent: May 25, 1999

[54] APPARATUS AND METHOD FOR REMOVAL OF ADHESIVE-BACKED OBJECTS ATTACHED TO A LINER

[75] Inventor: Craig R. Smythe, Lino Lakes, Minn.

[73] Assignee: Minnesota Mining and Manufacturing Company, St. Paul, Minn.

[21] Appl. No.: 08/938,537

[22] Filed: Sep. 26, 1997

[51] Int. Cl.[6] ..... B32B 31/00

[52] U.S. Cl. ..... 156/249; 156/344; 156/541; 156/584; 221/73; 221/210; 221/268; 16/86 R

[58] Field of Search ..... 156/249, 344, 156/584, 541; 29/402.03, 426.3; 16/86 R; 221/73, 210, 268

[56] References Cited

U.S. PATENT DOCUMENTS

| | | | |
|---|---|---|---|
| 3,190,785 | 6/1965 | Comet | 156/249 X |
| 4,555,299 | 11/1985 | Voltmer et al. | 156/552 |
| 4,607,761 | 8/1986 | Wright et al. . | |
| 4,792,259 | 12/1988 | Elgenmann . | |
| 5,092,954 | 3/1992 | Braun et al. . | |
| 5,482,899 | 1/1996 | McKenna et al. | 156/344 |

*Primary Examiner*—Mark A. Osele

*Attorney, Agent, or Firm*—Charles D. Levine

[57] ABSTRACT

An apparatus for removal of adhesive-backed objects attached to a liner with the objects and liner constituting a pad which includes a curved surface and a removal head. The curved surfaces preferably a drum, is adapted to receive the pad of the adhesive-backed objects for disposition around the drum with a radius sufficient to spread the individual objects of the pad apart. The removal head is positioned adjacent the drum for selectable engagement with the objects of the pad. The removal head includes at least one piston movable between a first position out of contact with the pad and a second position where the piston contacts the pad and applies a force thereto to securely maintain the position of the pad around the drum. The removal head further includes at least one gripper member positioned for engagement with an individual object of the pad. The gripper member is movable between a first position away from the drum and a second position adjacent an individual object attached to the liner. The gripper member moves from the first to the second position when the piston is applying a force against the pad. The gripper member is pivotable between an open and closed position to securely engage the individual object attached to the liner of the pad at which point the gripper member retracts radially away from the drum and removes the individual object from the liner of the pad with the piston holding the pad against the drum.

11 Claims, 14 Drawing Sheets

APPARATUS AND METHOD FOR REMOVAL OF ADHESIVE-BACKED OBJECTS ATTACHED TO A LINER

BACKGROUND OF THE INVENTION

1. Field of the Invention

This invention relates generally to the field of manufacturing assembly and more particularly to an apparatus and method for removal of adhesive-backed objects attached to a liner.

2. Description of the Art

In numerous manufacturing applications, it is well known to attach adhesive-backed molded objects to a particular product for protective or separation purposes such as feet, stops, or spacers. One example of such a molded object product is the Bumpon™ protective product manufactured by the 3M Company. Typically, these molded objects are manufactured in a pad form, wherein each pad includes numerous molded objects adhesively secured to a liner with the molded objects formed in columns and rows on the pad. The user of the molded objects removes an individual molded object from the pad and then places the molded object onto the end product in the particular application, such as the chassis of electronic devices, cabinetry, etc. The typical technique for application of the molded object to an end product is to manually remove a molded object from the pad and then attach the molded object to the end product. This is a labor-intensive and time-consuming process and is tedious for the person manually removing the molded objects from the liner and then applying the molding object to the end product. Additionally, the person may encounter physical problems due to the repetitious nature of the process.

Attempts to automate the process of removing the molded objects from the pad face numerous obstacles. First, the molded objects are typically die-cut during manufacture to separate the individual objects from each other which often causes perforations in the liner of the pad. This results in the liner, typically made from a paper material, being quite susceptible to tearing as the molded objects are removed. Excessive liner tearing can make it difficult to position the pad and remove subsequent molded objects. Additionally, a typical application may require several molded objects to be applied to an end product during each machine cycle so that methods for removing an entire row of molded objects from the pad, such as by running the pad over a sharp corner to dislodge the molded objects from the liner, are not acceptable. Such methods are not able to remove a specified number of molded objects or retain the objects for subsequent placement onto the end product for a particular application.

What is needed is an automated process and apparatus for removing adhesive-backed objects attached to a liner which is capable of removing a specified number of objects from a particular row of the liner with minimal or no tearing of the liner. Such a process should further be capable of then removing remaining objects on the particular row in a controlled manner and then proceeding to the next row of the pad until all the molded objects on the pad are removed. Such a process would preferably provide for transportation of the molded objects for direct placement onto the end product or to a specified location for subsequent placement onto the end product.

SUMMARY OF THE INVENTION

The present invention provides an apparatus and method for removal of adhesive-backed objects from a liner wherein a preselected number of objects are removed at one time with minimal or no tearing of the liner for direct or subsequent placement onto an end product.

According to one aspect of the present invention, there is provided an apparatus and method for removal of adhesive-backed objects attached to a liner which includes a curved surface and a removal head. The curved surface is preferably in the form of a drum and the drum is adapted to receive a pad consisting of the adhesive-backed objects and liner and the drum has a radius sufficient to spread the individual objects on the pad apart from one another. This allows for sufficient clearance for removal of an individual object of the pad. The removal head is positioned adjacent the drum for selectable engagement with the objects of the pad disposed around the drum. The removal head includes at least one piston movable between a first position out of contact with the pad disposed around the drum and a second position where the piston contacts the pad and applies a force thereto to securely maintain the position of the pad with molded objects around the outer surface of the drum. The removal head further includes at least one gripper member positioned for engagement with an individual object of the pad. The gripper member is movable between a first position away from the pad disposed around the drum and a second position adjacent an individual object of the pad. The gripper member moves from the first to the second position when the piston is in the second position applying a force against the pad to hold the pad in place against the drum. The gripper member is pivotable between an open and closed position such that when the gripper member moves to the second position adjacent an individual object, the gripper member is in the open position. The gripper member then pivots to the closed position to securely engage the individual object of the pad at which point the gripper member retracts radially away from the drum back to the first position and the gripper member removes the individual object from the liner of the pad with the piston holding the pad in place against the drum.

Pursuant to another embodiment of the present invention, a conveyor is provided for moving the pad around the drum. The conveyor preferably further advances the pad after the removal head has removed all the individual objects from a particular row of the pad so that the objects in the next row can then be removed by the removal head. In one embodiment, the apparatus includes pinch rollers for engagement with the pad as the conveyor advances the pad around the drum. The pinch rollers forcibly contact the pad between individual objects on the pad to align the pad and retain it against the drum so that the gripper member can successfully engage and remove the individual objects from the pad. The pinch rollers also maintain the liner of the pad in contact with the belt of the conveyor moving the pad around the drum.

In accordance with another embodiment of the present invention, a pair of opposing side clamping pistons are provided for selective engagement with the objects of the pad disposed around the outer surface of the drum. The side clamping pistons are positioned adjacent the outer surface of the drum and extend substantially parallel to the drum surface for selective engagement with the pad. The side clamping pistons engage the pad to retain the pad in place around the drum prior to and after the piston of the removal head engages the pad.

According to another aspect of the present invention, after removal of an individual object from the liner of the pad by the gripper member, the removal head is preferably movable to a preselected location where the gripper member then pivots back the open position to dispense the individual object either directly onto the end product or onto a transfer mechanism for subsequent placement onto the end product. The removal head then returns to its position adjacent the drum to remove additional individual objects from the pad. The removal head is realigned in this process so that the gripper member removes another object located in a different position on the pad. Preferably, once the removal head has removed all the objects on a particular row of the pad, the conveyor and pinch rollers further advance the pad around the drum so that the next row of objects are disposed adjacent the removal head for removal.

The above-described features and advantages, along with various other advantages and features of novelty, are pointed out with particularity in the claims of the present application which form a part hereof. However, for a better understanding of the invention, its advantages, and objects obtained by its use, reference should be made to the drawings which form a further part of the present application and to the accompanying descriptive manner in which there is illustrated and described preferred embodiments of the invention.

DETAILED DESCRIPTION OF THE INVENTION

Figure 4:
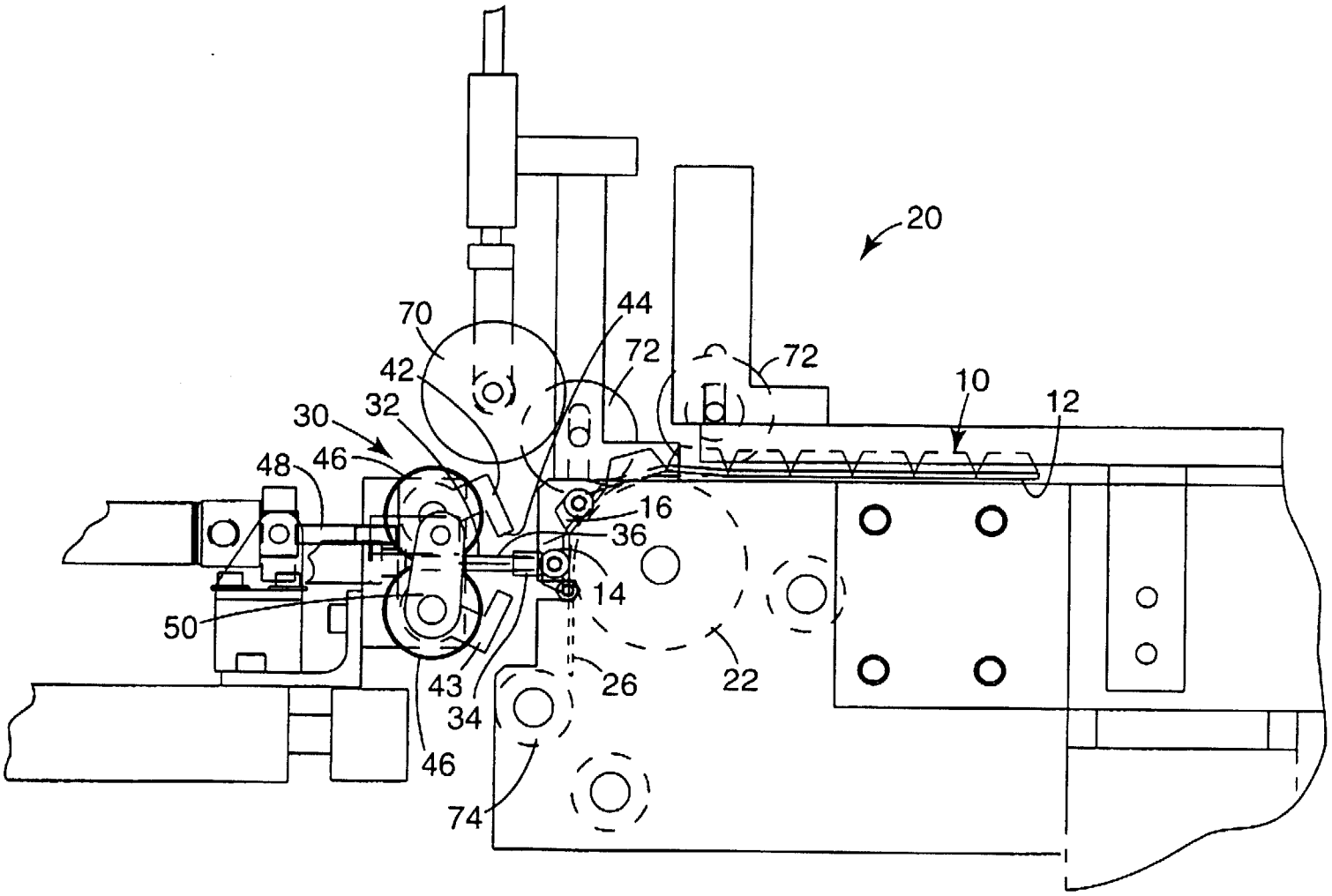
FIG. 4 is a side view of an apparatus for removal of adhesive-backed objects attached to a liner according to the principles of the present invention with the gripper members in the first position away from the pad disposed around the drum and the piston in its second position in contact with the pad.

Referring now to the drawings in which similar elements are numbered identically throughout, a description of the preferred embodiment is provided. Referring to FIG. 4, a side view of the apparatus for removal of adhesive-backed objects from a liner of a pad is generally illustrated at 20.

The removal apparatus 20 is designed for use with a pad 10 which consists of numerous adhesive-backed objects 14, 16 attached to a liner 12. A typical example of such an adhesive-backed object is the Bumpon™ protective product manufactured by the 3M Company. The Bumpon™ protective products are adhesive-backed polyurethane products that can be used as feet, stops, spacers, and protectors in a variety of applications. The Bumpon™ products are attached to a liner which is typically made from a paper material or other similar material. The Bumpon™ protective products are typically manufactured in a pad form with numerous Bumpon™ products arranged in columns and rows on the pad. The Bumpon™ products are manufactured in a variety of sizes and shapes, such as hemisphere, tapered square, or cylindrical, for specific applications (see FIGS. 14A–14D).

Figure 1:
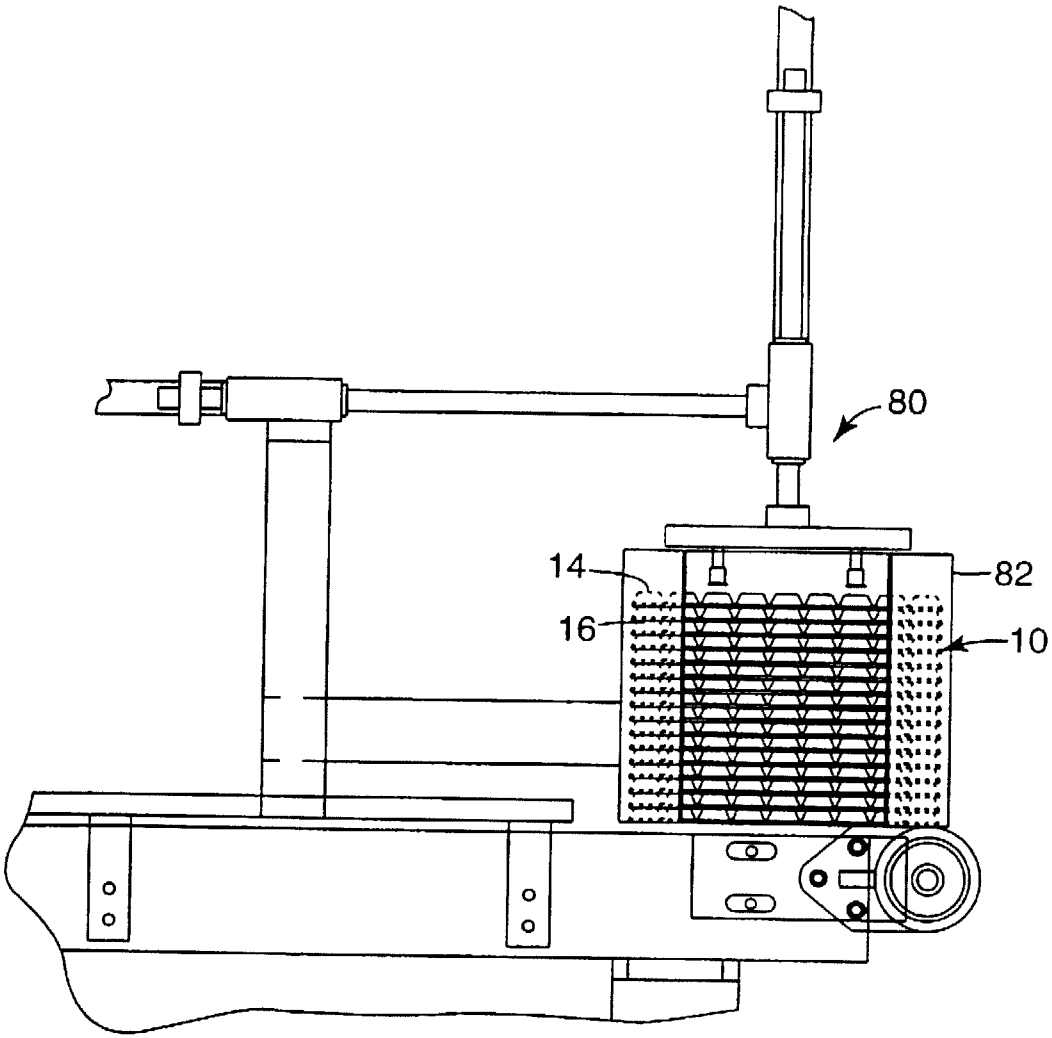
FIG. 1 is a side view of a storage location of numerous pads of adhesive-backed objects attached to a liner.
Figure 3:
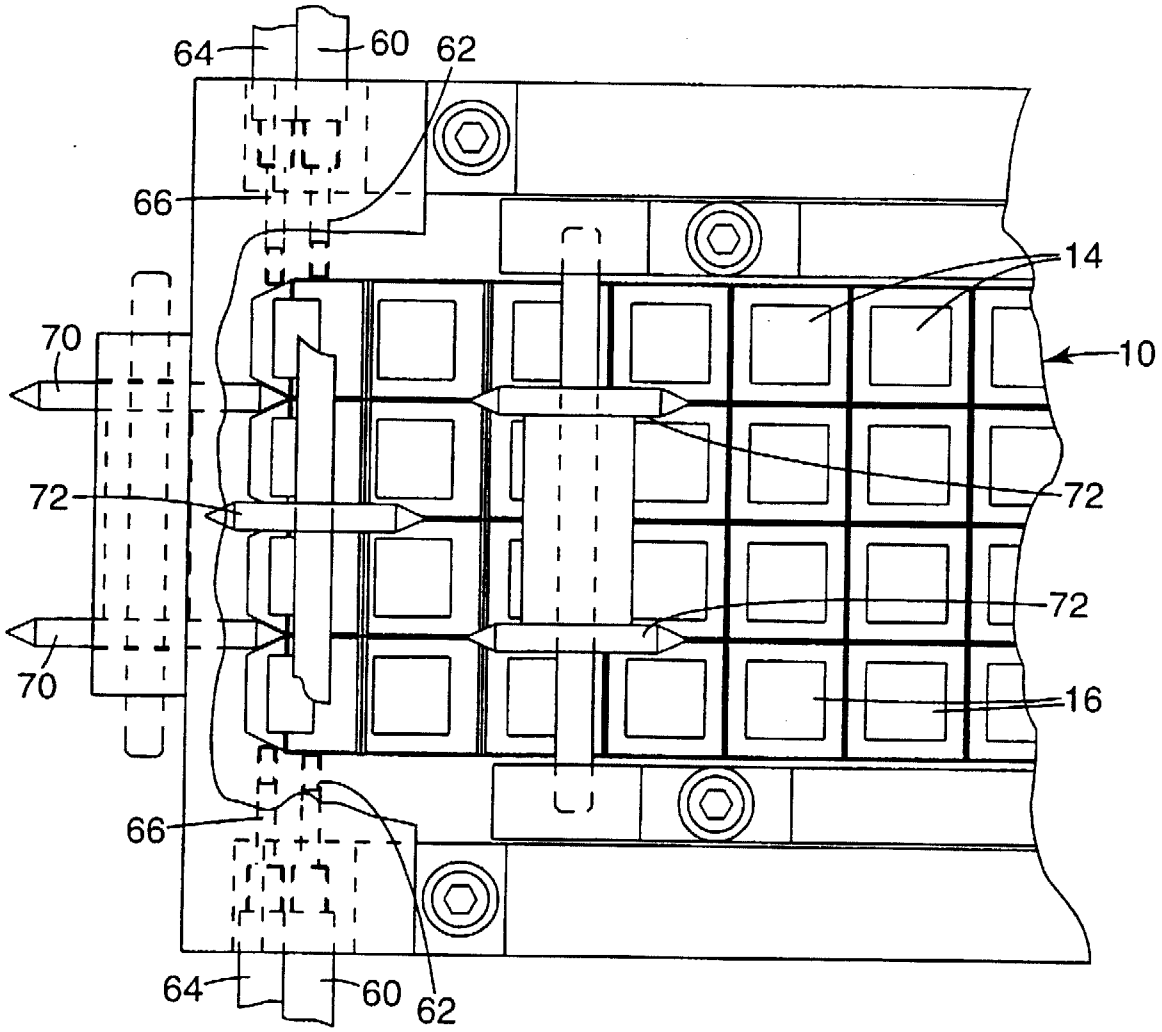
FIG. 3 is a top plan view of the apparatus shown in FIG. 2.
Figure 14C:
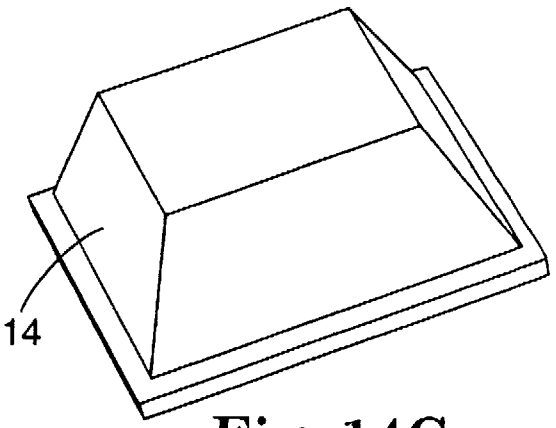
FIGS. 14A–14D are perspective views of various adhesive-backed molded objects.
Figure 14D:
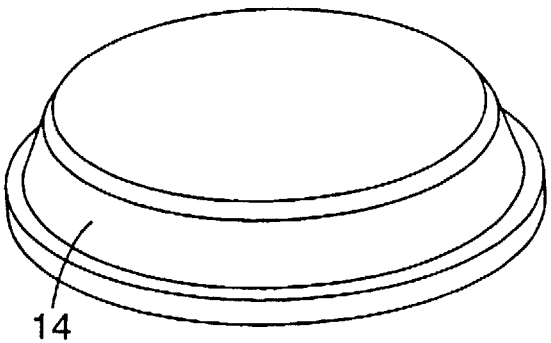
Figure 14A:
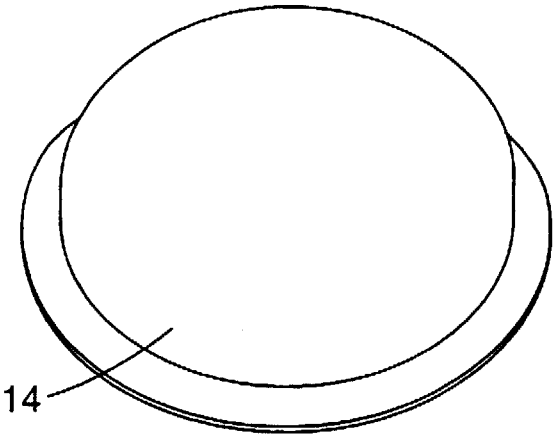
Figure 14B:
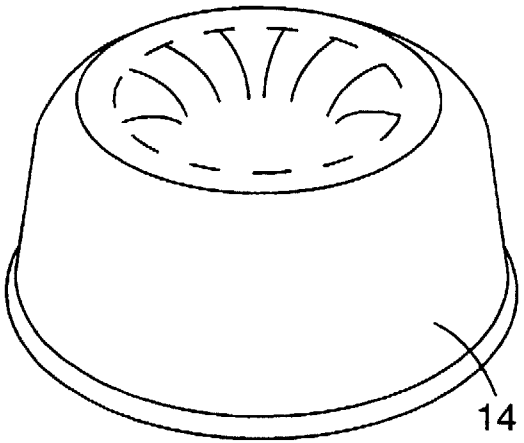

Referring to FIGS. 1 and 14C, the molded objects are shown as having a tapered square shape for illustrative purposes. It is appreciated that the molded objects may be formed in other shapes and sizes such as a hemisphere or cylindrical shape and still be capable of removal by the removal apparatus (see FIGS. 14A, 14B, 14D). Referring to FIGS. 1 and 3, the molded objects and liner are illustrated in a sectional pad form with the molded objects in rows of four across with nine columns for a total of 36 molded objects on a single pad. This typical pad is for illustrative purposes only and the number, size and shape of the molded objects may be varied in accordance with the principles of the present invention. Additionally, while the molded objects are illustrated in a sectional pad form, the molded objects may alternatively be formed as a continuous roll pad which would feed into the removal apparatus 20 (FIG. 4) for subsequent removal of the objects from the roll pad. Such a roll pad could be mounted on a reel and utilize a liner take-up reel for collecting the liner after the objects have been removed.

Figure 2:
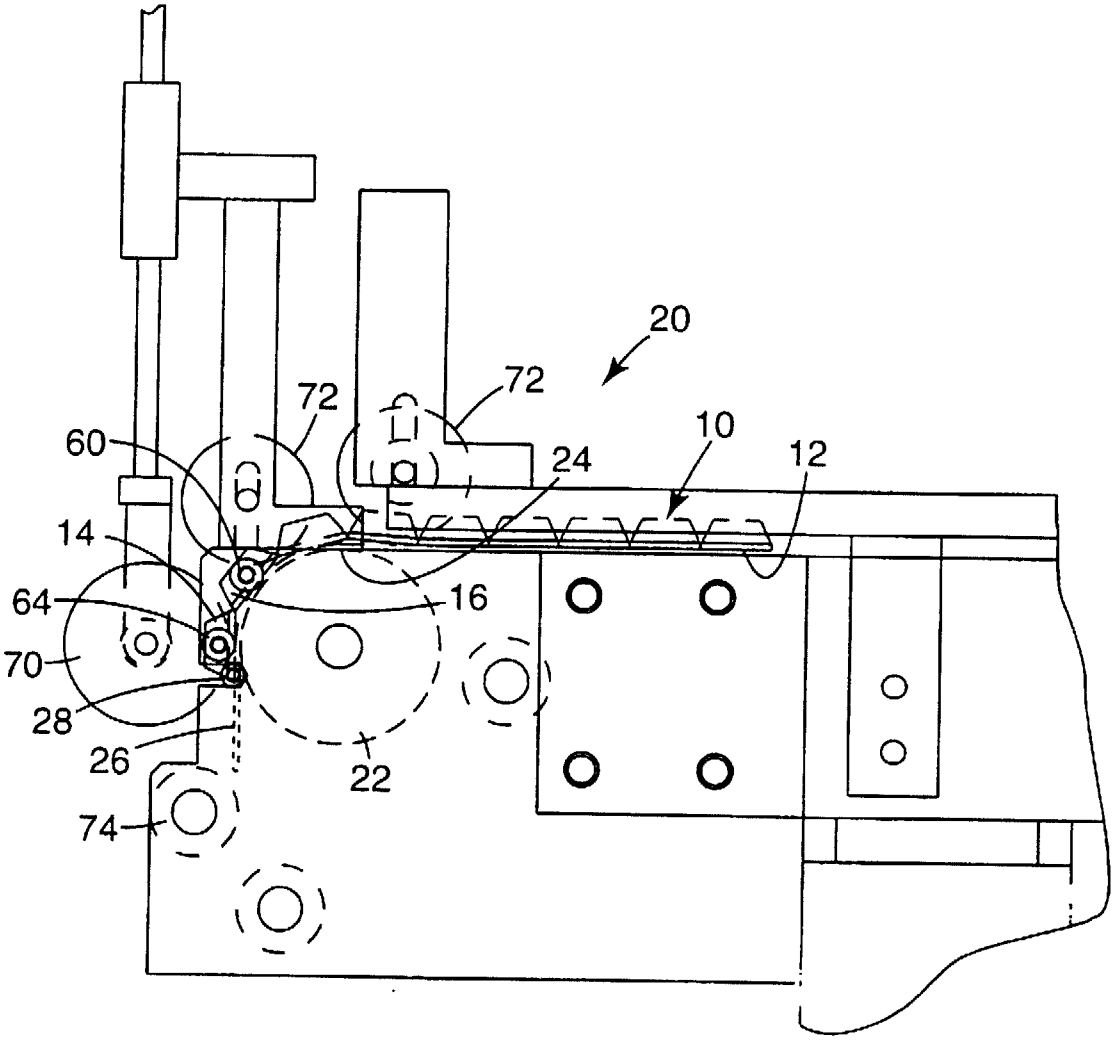
FIG. 2 is a side view of a portion of an apparatus for removal of adhesive-backed objects attached to a liner according to the principles of the present invention.

Referring to FIG. 2, the removal apparatus 20 includes a curved surface which is illustrated in this embodiment in the form of a drum 22 having an outer surface 24. The radius of the drum 22 is chosen such that when the pad 10 containing the molded objects 14, 16 is disposed around the drum, the individual molded objects 14,16 are sufficiently separated or spread out from one another (see FIG. 2) so that the removal apparatus 20 is able to engage an individual object 14 for removal. It should be noted that the radius of the drum is chosen such that the molded objects do not dislodge or shear off from the liner as they pass over the outer surface of the drum. It is further appreciated that while this embodiment illustrates the curved surface in the form of a drum, other curved surfaces may be utilized in accordance with the principles of the present invention. For example, a radius section of rigid material or a partial section of a drum could be positioned to receive the pad thereon for removal of the molded objects.

According to one aspect of the present invention, a conveyor 26 is preferably connected to the drum 22 and may take the form of a belt. The conveyor 26 is designed to transport a pad 10 consisting of molded objects 14, 16 and liner 12 around the drum outer surface 24. Pursuant to one embodiment of the invention, pinch rollers are preferably provided to assist in alignment of the pad 10 and for maintaining the pad 10 in position around the outer surface 24 of the drum 22. Front pinch rollers 70, as shown in FIG. 2, are adapted for engagement with the pad 10 between the molded objects 14, 16, with the pad 10 disposed around the drum 22. These front pinch rollers 70 are movable between the pad contact position (FIG. 2) and a retracted position (FIG. 4) which allows the removal head 30 to access the individual objects on the pad 10 disposed around outer surface 24 of drum 22. The front pinch rollers 70 are lowered into the pad contact position (FIG. 2) as the pad 10 is advanced by the conveyor 26 along the surface 24 of the drum 22. A sensor 28 (FIG. 2) is preferably located adjacent the drum 22 to monitor the position of the molded objects 14, 16 on the pad 10 such that when a row of objects is perceived by the sensor, the conveyor 26 stops and the row of objects on the pad are positioned for removal by the removal head 30.

Preferably, rear pinch rollers 72 are also provided for engagement with the pad as the pad travels along the conveyor 26 and drum 22. As shown in FIGS. 2–3, these rear pinch rollers 72 similarly engage the pad 10 between the molded objects 14, 16. This serves to align the molded objects 14, 16 of the pad 10 on the drum 22 in a specific orientation so that the removal head 30 is able successfully engage and remove selected molded objects from the pad 10. The pinch rollers 70, 72 are positioned to forcibly contact the pad 10 and convey the pad along drum 22 which serves to retain the pad 10 in position around the outer surface 24 of the drum 22.

It is appreciated that alternative mechanisms may be utilized in place of the pinch rollers to advance the pad 10 around the drum 22 and maintain the position of the pad adjacent the drum. For example, the drum 22 may be equipped with a vacuum mechanism (not shown) which would hold the pad 10 in position around the drum 22 as the individual objects are removed from the pad 10.

Figure 7:
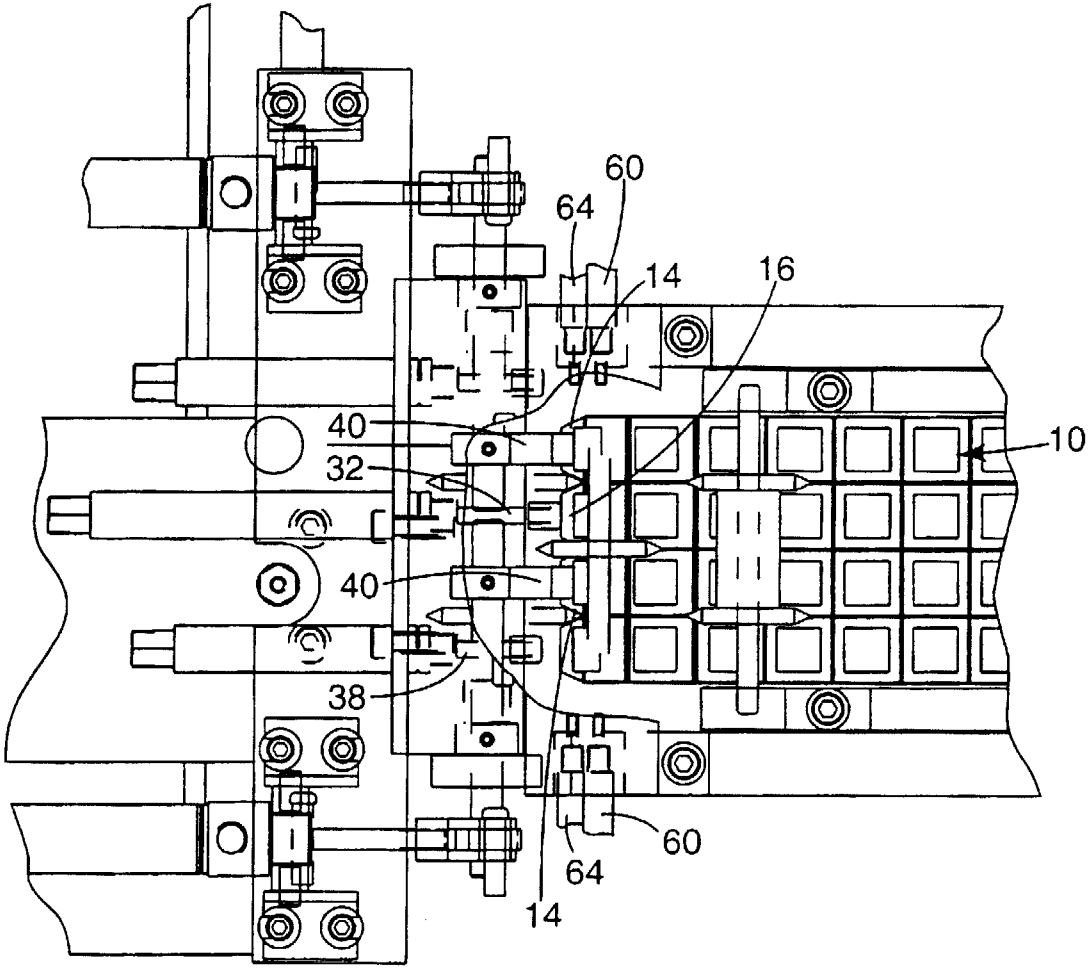
FIG. 7 is a top plan view of the apparatus shown in FIG. 6.

According to another embodiment of the present invention, side clamping pistons are preferably provided to assist in maintaining the positioning of the pad 10 around the outer surface 24 of the drum 22 as consecutive rows of molded objects are removed from the pad. Referring to FIGS. 3–4, the removal apparatus 20 preferably includes a pair of top side clamping pistons 60 and bottom side clamping pistons 64. These pistons are disposed adjacent the surface 24 of the drum 22 on opposite sides of the pad 10 which is disposed around the drum 22. The side pistons 60, 64 each include a shaft, 62, 66, which extends from a retracted position (see FIG. 7) to an extended position (see FIG. 3) in contact with the outermost, adjacent molded object on each side of the pad 10. The side pistons 60, 64 serve to maintain the position of the pad 10 around the outer surface 24 of the drum 22 once the front pinch rollers 70 are retracted and while the removal head 30 positions itself for removal of the molded objects. The side pistons 60, 64 are retractable to a position out of engagement with the molded objects of the pad 10 to allow the pad to move around the drum 22 for removal of subsequent rows of molded objects from the pad.

Figure 5:
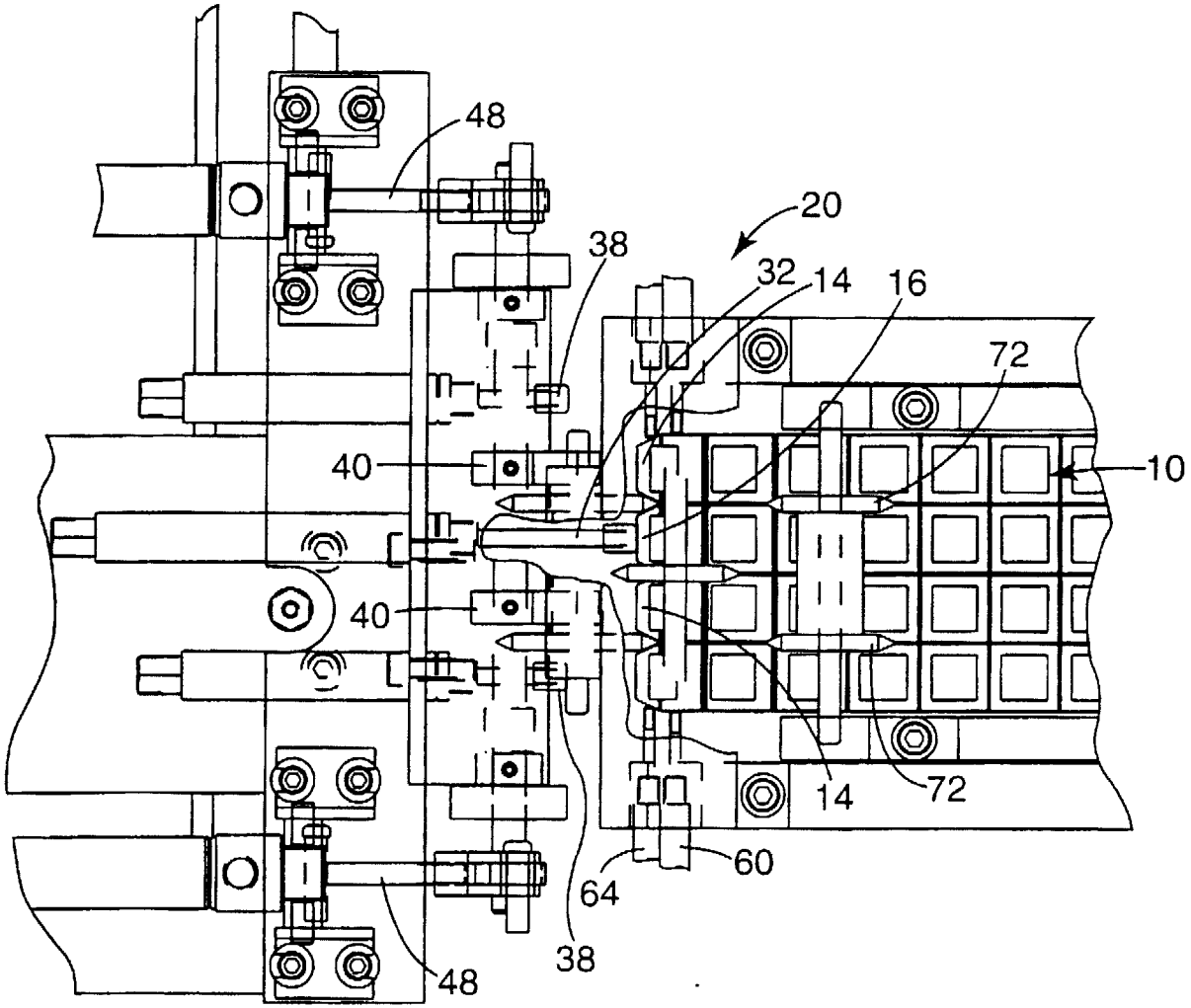
FIG. 5 is a top plan view of the apparatus shown in FIG. 4.
Figure 12:
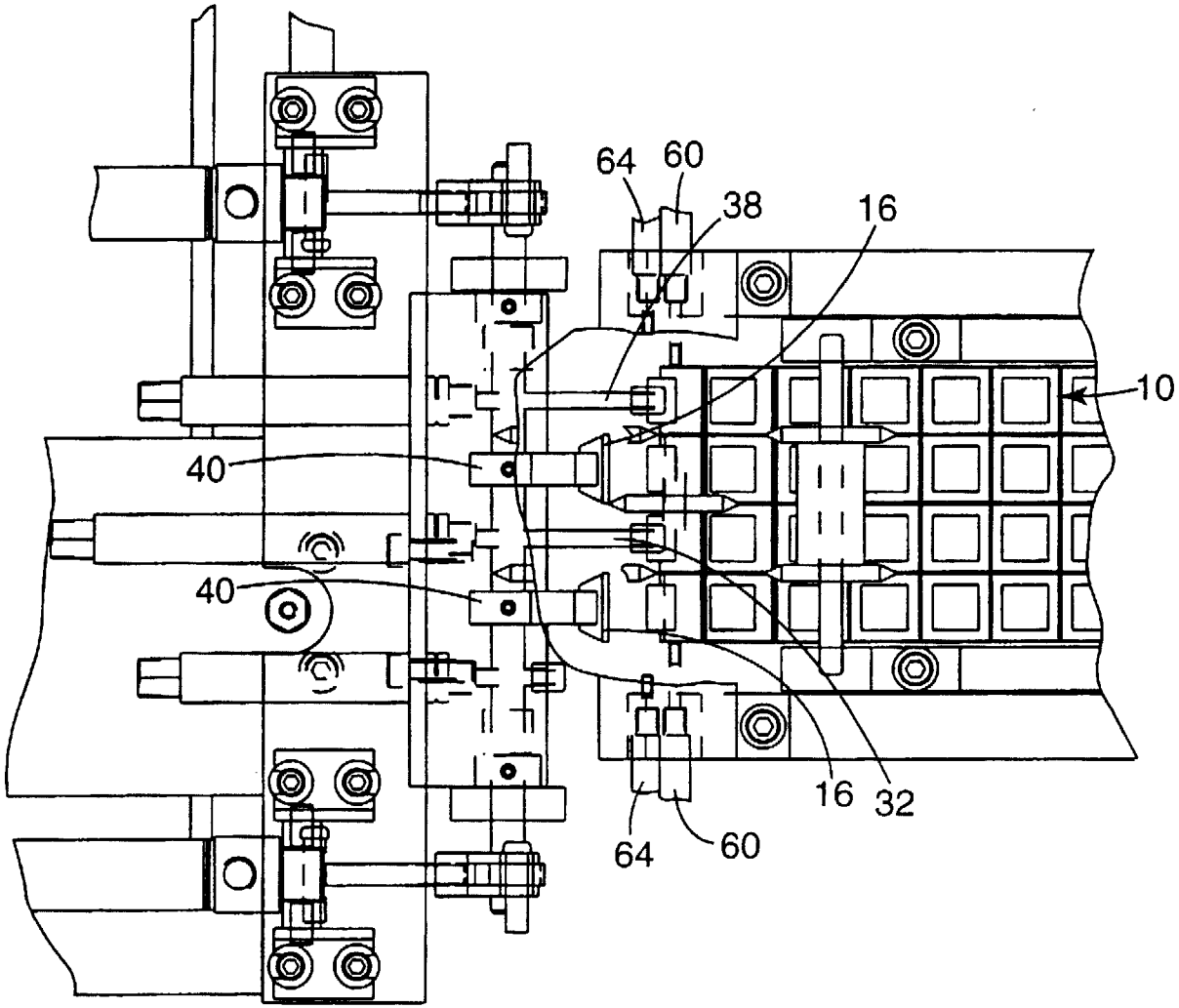
FIG. 12 is a top plan view of the apparatus shown in FIG. 11.
Figure 13:
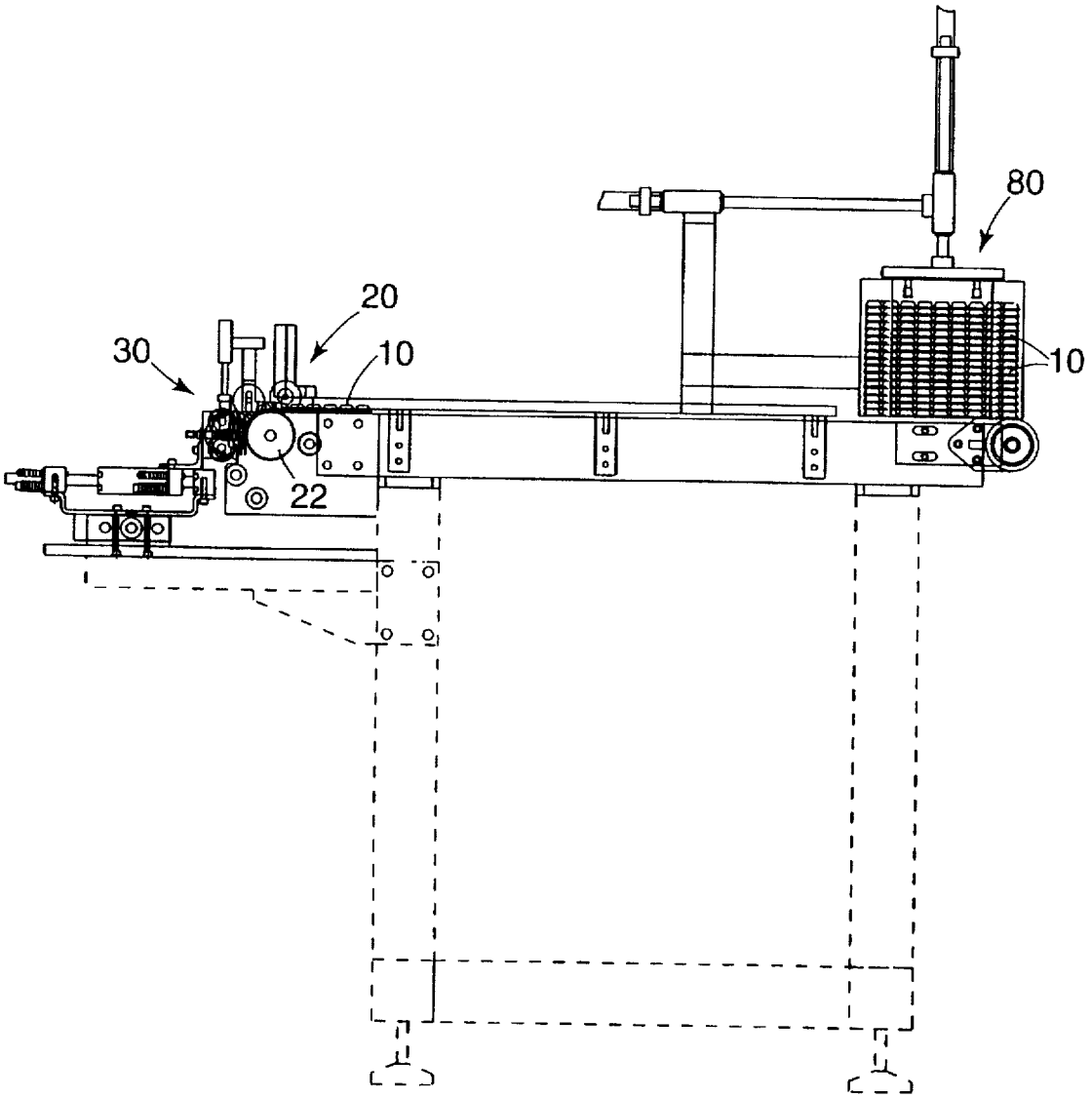
FIG. 13 is a side view of an apparatus for removal of adhesive-backed objects attached to a liner according to the principles of the present invention.

Referring to FIGS. 4–5, the removal apparatus 20 includes a removal head 30 disposed adjacent the drum 22 for removal of the molded objects 14, 16 from the liner 12 of the pad. The removal head 30 includes a middle piston 32 having a shaft 36 and contact head 34. The middle piston is movable from a retracted position away from the drum 22 to an extended position (see FIG. 4) in which the contact head 34 of the middle piston 32 engages the central portion of the pad 10 to secure the pad against the drum 22. The removal head 30 also preferably includes end pistons 38 which are similarly movable between a retracted position (see FIG. 5) and an extended position (see FIGS. 10, 12) in contact with the pad 10 against the drum 22.

The removal head 30 further includes at least one gripper member 40 which is designed for engagement and removal of an individual molded object from the pad. Referring to FIGS. 4–5, two gripper members are shown with each gripper member 40 including opposing arms 42, 43 which are pivotal between an open and closed position. In a preferred embodiment, the opposing arms 42, 43 of the gripper member 40 are pivotable by a piston 48 which pivots a crank arm 50 connected to gears 46 which rotate to pivot the gripper arms between the open and closed positions (See FIG. 4). It is appreciated that other closure mechanisms such as a rotary cylinder or electric motor may be utilized to pivot the gripper arms. Preferably, a separate closure mechanism is provided for each gripper member so that each gripper member operates independently to close onto the particular individual molded object to be removed.

Figure 6:
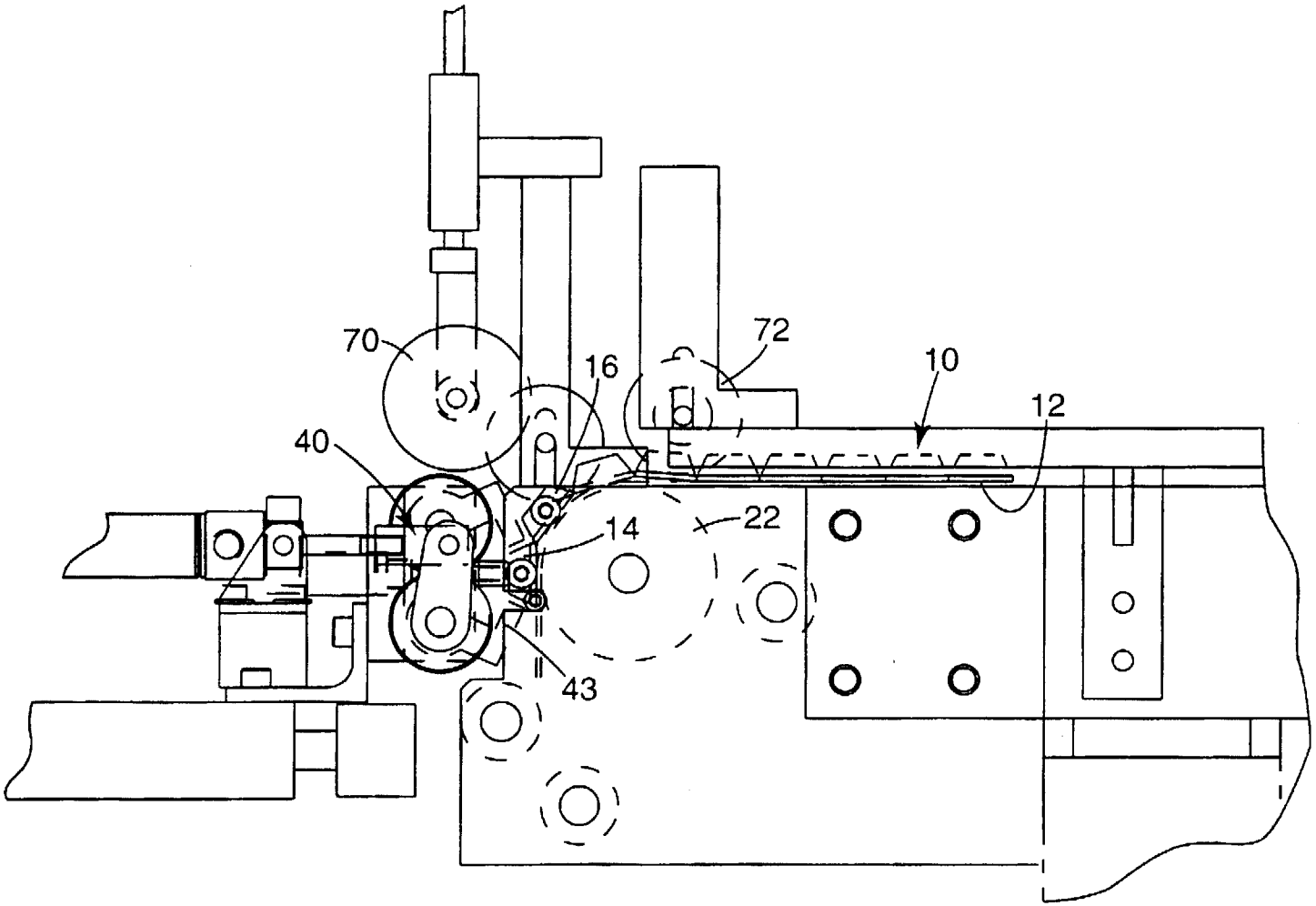
FIG. 6 is a side view of the apparatus shown in FIG. 4 with the gripper members extended to the second position adjacent an individual object of the pad.

Additionally, the gripper member 40 is movable to a position adjacent the drum 22 such that the opposing arms 42, 43 of the gripper member 40 are disposed adjacent an individual molded object 14 to be removed from the pad 10 (see FIG. 6). The gripper member 40 is retractable back to a position away from the drum 22 for removing an individual object 14 from the pad 10.

In a preferred embodiment, the removal head pistons 32, 38 and gripper members 40 are driven by air cylinders. It is appreciated that a variety of other mechanisms such as hydraulics and electric systems may be used to drive the pistons 32, 38 and gripper members 40 of the removal head 30 in accordance with the principles of the present invention. Similarly, air cylinders are preferably utilized with the side pistons 60, 64.

The sequence of operations for the removal apparatus 20 will now be described with respect to a particular illustrated application. In the illustration, the molded object pad 10 includes four columns of nine rows of molded objects attached to the liner 12 of the pad 10. The illustrated application calls for the removal of two molded objects from the pad 10 at one time (i.e., one machine cycle) for subsequent placement onto an end product requiring two objects, such as a cabinet drawer or bottom. It is appreciated that the invention may be modified to address the requirements of the specific application. For example, if a manufacturing application requires the removal of three molded objects from the pad for placement onto an end product requiring three molded objects during each machine cycle, the removal head would be modified to have three gripper members for removal of the molded objects from the pad at a single time. Alternatively, the invention may be modified to allow for removal of a partial quantity of molded objects at one time for an end product requiring numerous molded objects. For the example described above, the removal head could be set up to remove a single molded object from the pad during each cycle for placement onto an end product which requires a total of three molded objects.

Referring to FIG. 1, a stack of molded object pads 10 are disposed in a storage bin 82 for subsequent removal of the molded objects from the pad 10 and placement onto an end product. A suitable pick and place mechanism 80 is utilized to remove a single pad 10 of molded objects 14 and place the pad on the conveyor 26 for transport to the drum 22. Referring to FIG. 2, the front pinch roller 70 is mounted on a slide and extends downward into the pad contact position adjacent the drum 22 for engagement with the first row of the molded objects on the pad 10. Similarly, the rear pinch rollers 72 engage the pad 10 as it moves along the conveyor 26 to align the molded objects of the pad around the outer surface 24 of the drum 22.

Referring to FIG. 6, the drum 22 radius is selected so as to spread the individual molded objects 14, 16 on the pad apart enough so that there is enough clearance for removal by the gripper members 40 of the removal head 30. It is appreciated that the size and shape of the molded objects may vary (see FIGS. 14A–14D) so the drum radius may be varied accordingly to accommodate the particular size, shape and spacing of the molded objects to be removed.

When the sensor 28 (FIG. 2) detects the leading edge of the first row of molded objects 14, 16, the conveyor stops moving by shutting down the motor drive and engaging a brake. At this time, both the top clamping side pistons 60 and bottom clamping side pistons 64 extend outward to engage the adjacent molded objects and retain the pad 10 around the outer surface 24 of the drum 22 (FIGS. 2, 3). The front pinch rollers 70 then retract upward out of the way of the removal head 30 (see FIG. 4).

Referring to FIGS. 4–5, the middle piston 32 extends forward to contact a molded object 16 and hold the pad 10 in position against the drum 22. In this embodiment, the middle piston 32 contacts a molded object 16 adjacent to and in the same row as the molded objects 14 to be removed in this cycle. At this time, the side pistons 60, 64 retract out of engagement with the pad 10. It is appreciated that while the middle piston 32 holds the pad 10 against the drum 22, other articles such as the conveyer belt may be disposed between the pad and drum.

Figure 8:
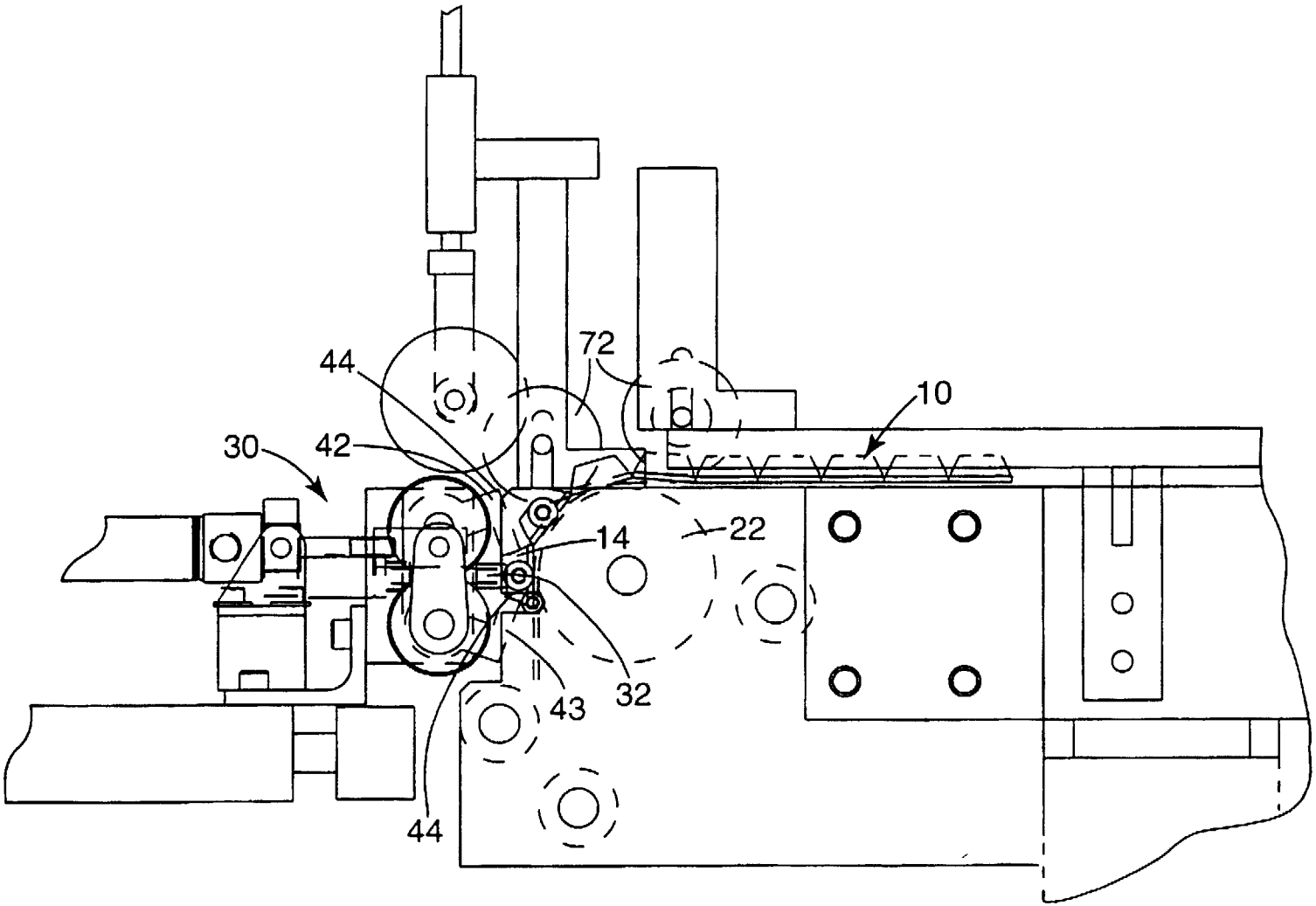
FIG. 8 is a side view of the apparatus shown in FIG. 4 with the gripper members in the closed position engaging an individual object of the pad.

Referring to FIGS. 5–6, the gripper members 40 of the removal head 30 advance forward to position the opposing arms 42, 43 of the gripper member for capture of the molded objects 14 to be removed from the liner 12 of the pad 10. As each gripper member 40 moves to this position adjacent the pad 10 and drum 22, the opposing arms 42, 43 are in the open position disposed on opposing sides of the molded object 14 to be removed (FIG. 6). Referring to FIG. 8, the gripper member 40 pivots the opposing arms 42, 43 closed such that the arms engage and clamp onto the molded object 14 to be removed. In a preferred embodiment, the opposing arms include a non-skid surface 44 which contacts the molded object 14 for improved retention of the molded object. Preferably, the gripper member is adapted to close to a position such that the gripper arms engage and slightly compress the molded object in order to maintain secure engagement.

Figure 9:
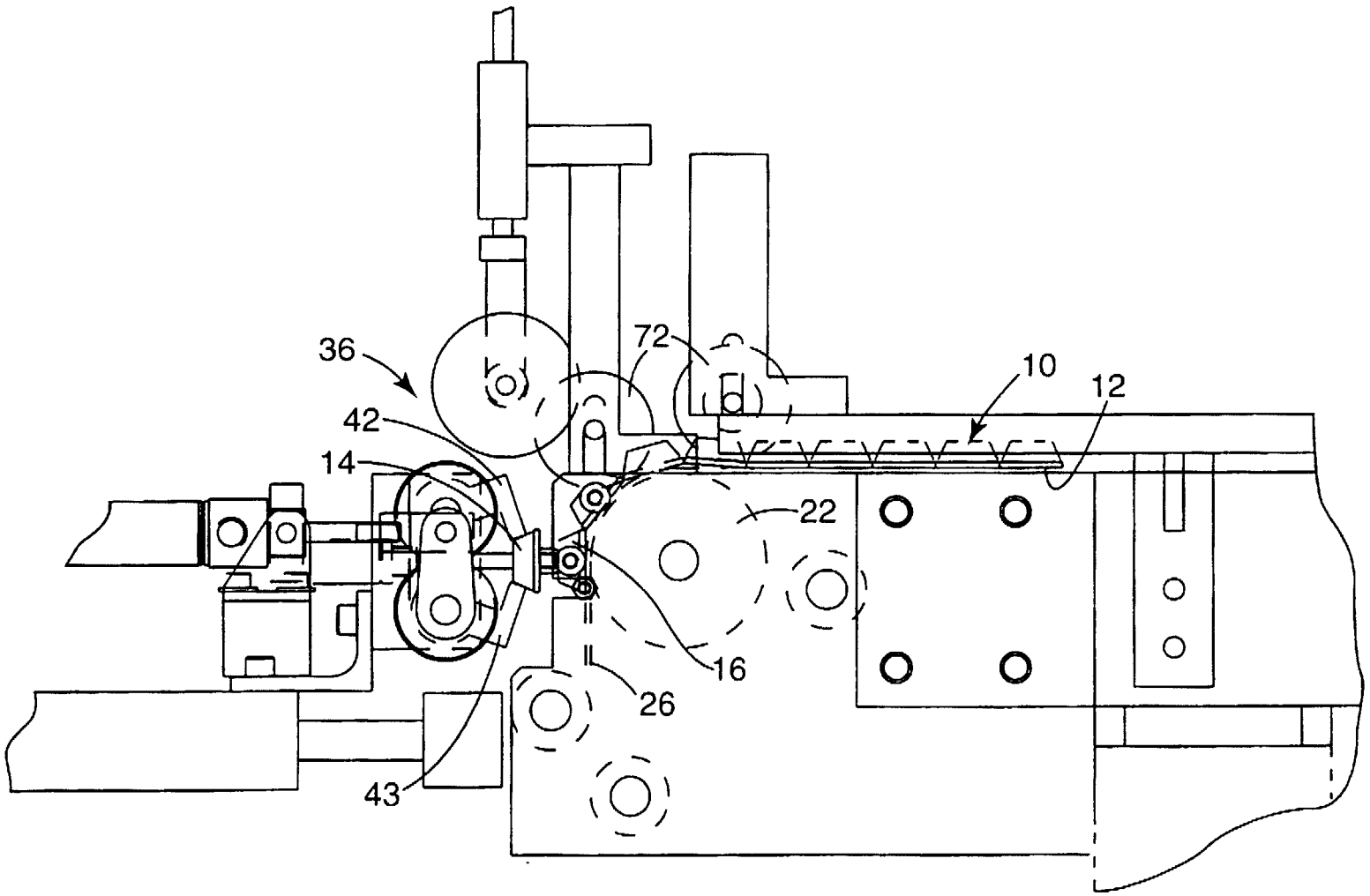
FIG. 9 is a side view of the apparatus shown in FIG. 4 with the gripper members retracted back to the first position away from the drum while in the closed position engaging an individual object after removal of the object from the liner of the pad.
Figure 10:
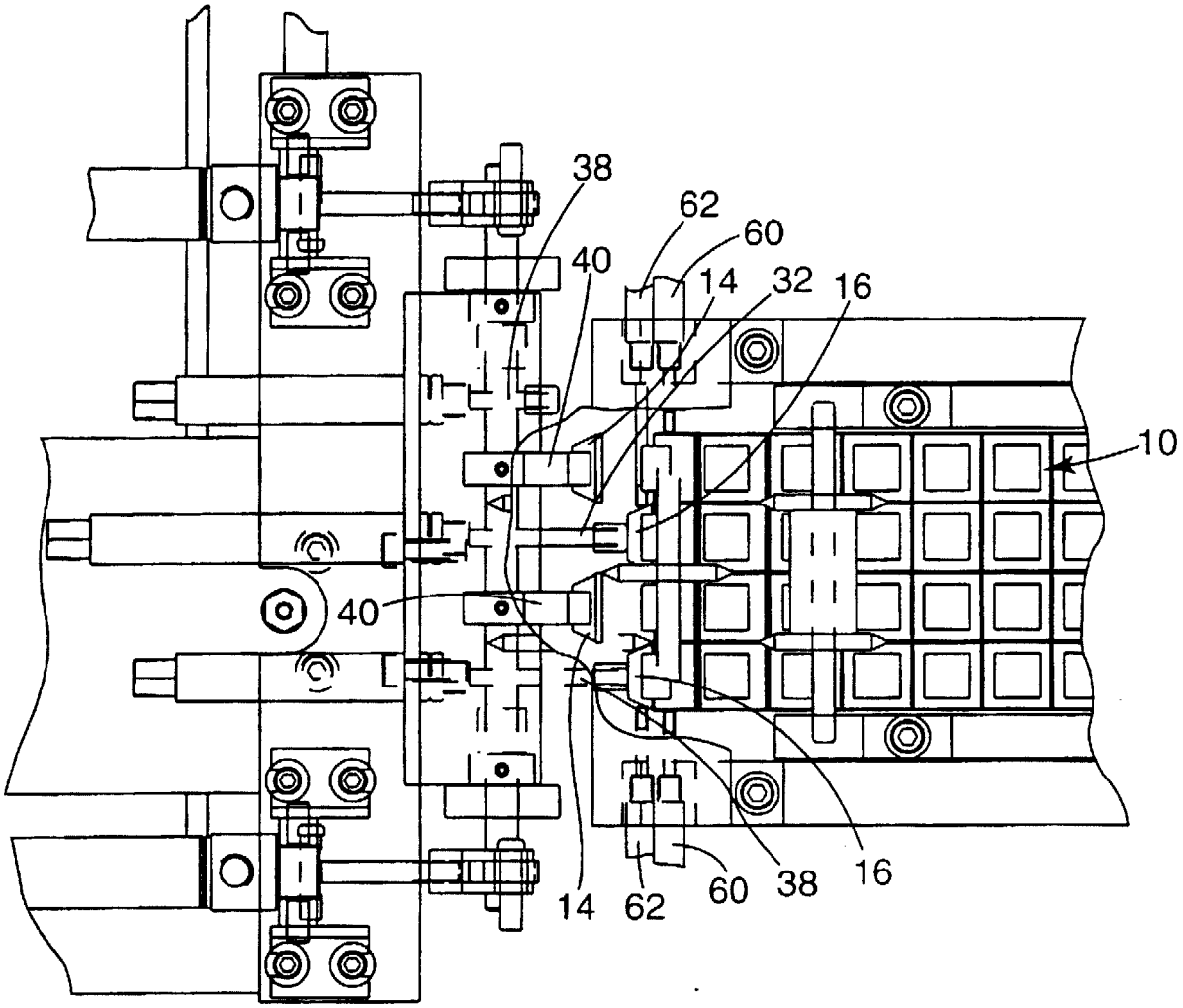
FIG. 10 is a top plan view of the apparatus shown in FIG. 9.

After each gripper member 40 has securely engaged the individual molded object 14 to be removed, the end pistons 38 extend outward to engage a molded object 16 on the pad 10 adjacent and in the same row as the molded object 14 to be removed (See FIG. 10). At this point, the gripper members 40 of the removal head 30 are retracted away from the drum 22 pulling the individual molded objects secured by the gripper members 40 off the liner 12 of pad 10. As shown in FIGS. 9–10, as the gripper member retracts radially away from the drum 22 to remove the molded object 14 from the liner 12 of pad 10, both the middle piston 32 and end piston 38 are extended to retain the adjacent molded objects 16 in position against the drum 22 and prevent tearing of the pad liner 12. It is appreciated that this method allows for removal of a specified number of molded objects from the pad at a single time with minimal or no tearing of the liner while also maintaining the position of the pad 10 for subsequent removal of additional molded objects. It is further noted that while the present illustration provides for both a middle piston 32 and end piston 38 to be in forceful contact with the pad 10 adjacent the molded objects to be removed, the adhesive strength of the molded objects is variable such that fewer pistons may be required to retain the pad 10 against the drum 22 during removal of molded objects than is illustrated in this present embodiment.

In a preferred embodiment, the gripper member 40 may be equipped with a suitable mechanism for sensing whether the gripper member has successfully engaged and removed a particular molded object from the pad. For example, the gripper member may be set up so that the opposing arms 42, 43 of the gripper member 40 are pivotable to a further closed position than is necessary to engage and retain an individual molded object. In such a case, if the gripper member for some reason does not securely engage the individual molded object to be removed, the gripper arms are pivoted to this further closed position by the piston 48. A magnetic switch (not shown) detects the extended position of the piston 48 and signals that the gripper arms have closed too far (i.e., object wasn't removed) and have not engaged the individual molded object to be removed. The apparatus may then recognize such a signal and retract the removal head from the pad and start over to engage and remove the particular molded object from the pad.

Once the gripper members 40 of the removal head 30 are retracted with the molded objects 14 retained in the gripper arms 42, 43, the top and bottom side pistons 60, 64 are extended to retain the pad 10 with the remaining molded objects in position around the outer surface 24 of the drum 22. The middle piston 32 and end piston 38 are retracted and the removal head 30 then moves a preselected location either directly adjacent the end product for placement of the molded objects 14 onto the end product or adjacent a transfer mechanism (not shown) for subsequent placement of the molded objects onto the end product. At this preselected position, the opposing arms 42, 43 of each gripper member 40 are pivoted open to dispense the molded objects 14 either directly onto the end product or onto the applicable transfer mechanism for subsequent placement onto the end product. Examples of such a transfer mechanism would include a rotating tray or a pivoting head.

Figure 11:
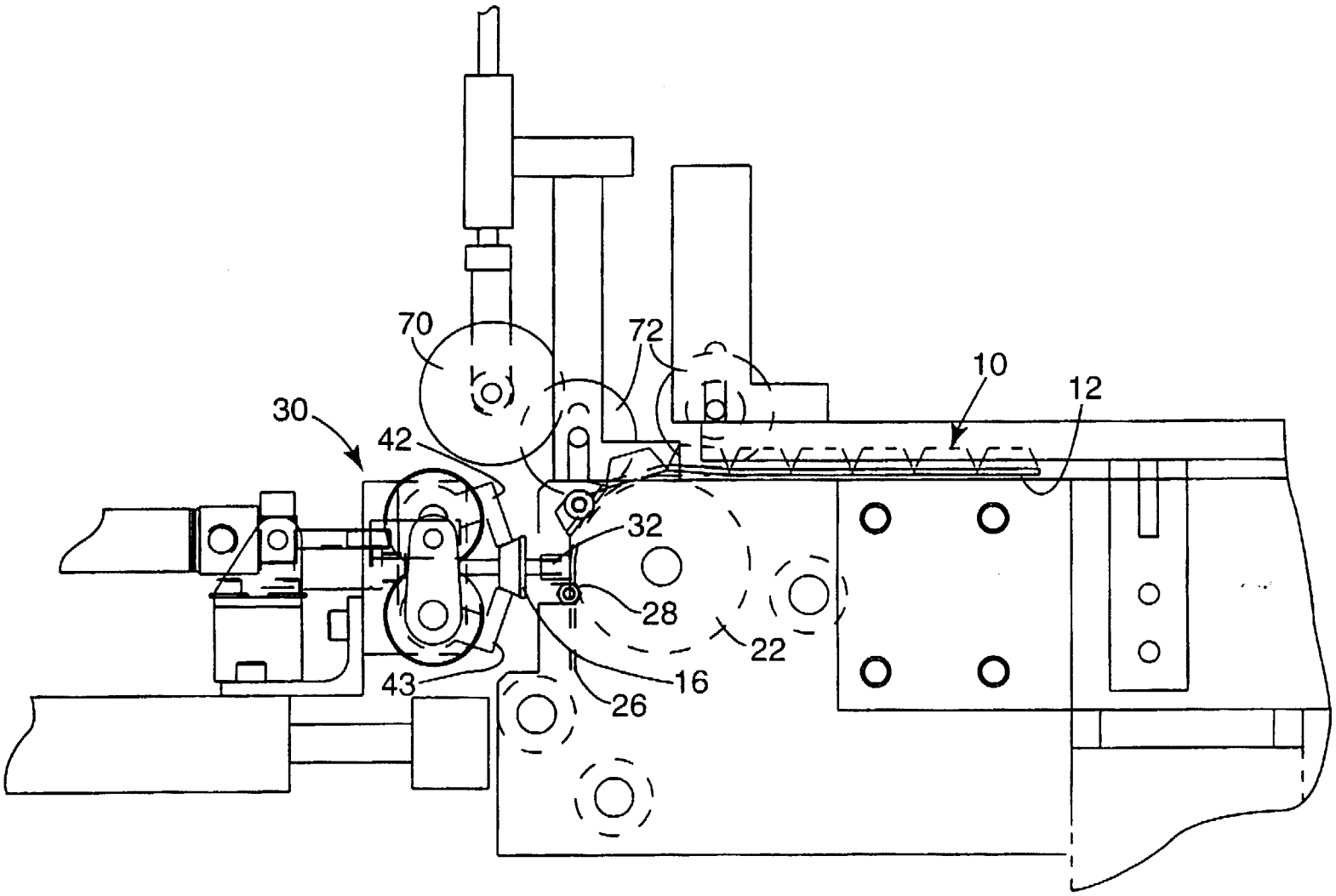
FIG. 11 is a side view of the apparatus shown in FIG. 4 with the removal head shifted to another column of the same row and the gripper member retracted back to the first position away from the drum while in the closed position engaging an individual object after removal of the object from the liner of the pad.

The removal head 30 then moves back adjacent the drum 22 for removal of the remaining molded objects 16 on this row of the pad 10. At this point, the removal head 30 is realigned for proper engagement with the remaining molded objects on the pad. The removal head now proceeds again through the above-described process where the middle piston 32 extends to contact the liner 12 portion of pad 10 adjacent the molded object 16 to be removed. The gripper members 40 then extend forward and the gripper arms 42, 43 pivot close to securely engage the remaining molded objects 16 on the row of the pad 10. The end piston 38 extends to contact the liner portion 12 of pad 10 adjacent the molded object 16 to be removed. The gripper members 40 then retract to remove the molded objects 16 captured by the gripper arms 40 with the pistons 32, 38 holding the pad against the drum 22 (see FIGS. 11–12). The pistons are retracted and the removal head 30 then moves to the end product or transfer mechanism and the gripper members pivot open to dispense the next cycle of molded objects directly onto the end product or for subsequent placement onto the end product. It is appreciated that in a particular application, the removal apparatus 20 may remove the entire row of molded objects at a single time. In such a case, the removal apparatus 20 would then advance the pad along the drum and the removal head 30 would return to the previous location for removal of the next row of molded objects.

Once an entire row of molded objects are removed by the removal apparatus 20, the conveyor 26 then moves the pad 10 around the outer surface 24 of the drum 22 until the sensor 28 perceives the next row of molded objects to be removed. The conveyor 26 then stops with the pinch rollers 70, 72 maintaining the position of the pad 10 around the drum 22. The side pistons 60, 64 then engage the pad 10 to secure the pad in place around the drum and the front pinch roller 70 is retracted out of the way and the process is then repeated where the removal head 30 removes the molded objects from this next row of the pad in the manner described above.

It is appreciated that the pinch rollers 70, 72 and side pistons 60, 64 in conjunction with the pistons 32, 38 of the removal head 30 work cooperatively together to continuously maintain a pad 10 in position around the outer surface 24 of the drum 22. This allows for proper alignment of the individual molded objects on the pad for removal by the gripper members 40 while also providing for controlled movement of the pad 10 around the drum 22 to facilitate removal of all the rows of molded objects from the pad. Further, after removal of all (or a sufficient number) of molded objects from a one pad, another pad is then placed onto the conveyor 26 for removal of the molded objects attached thereto.

According to another aspect of the present invention, a drive roller 74 is preferably positioned for engagement with the liner 12 of the pad 10 after the molded objects have been removed (see FIG. 2). The drive roller 74 aids in keeping the pad 10 around drum 22 and disposes of the liner 12 once all objects have been removed. It is appreciated that the apparatus can be modified for use with a continuous roll pad of molded objects secured to a liner such that the drive roller 74 could then be used as a take up reel to collect the pad liner after the molded objects have been removed. In such an alternative embodiment, the pick and place mechanism 80 and storage bin 82 (see FIG. 1) would be replaced with the pad constituting the roll stock of adhesive-backed objects mounted on a reel.

It is to be understood that even though numerous characteristics and advantages of various embodiments of the present invention have been set forth in the foregoing description, together with the details of the structure and function of various embodiments of the invention, this disclosure is illustrative only and changes may be made in the details, especially in matters of shape, size, and arrangement in part within the principles of the present invention, to the full extent indicated by the broad general meaning of the terms in which the appended claims are expressed.

Other modifications of the invention will be apparent to those skilled in the art in view of the foregoing descriptions. These descriptions are intended to provide specific examples of embodiments which clearly disclose the present invention. Accordingly, the invention is not limited to the described embodiments or to use of specific elements, dimensions, materials, or configurations contained therein. All alternative modifications and variations of the present invention which fall within the spirit and broad scope of the appended claims are covered.

What is claimed is:

1. An apparatus for removal of adhesive-backed objects attached to a liner where the objects and liner constitute a pad, said apparatus comprising:

a curved surface for receiving the objects and liner of the pad for disposition around the curved surface, the curved surface having a radius sufficient to spread the individual objects of the pad apart from one another;

a removal head positioned adjacent the curved surface and selectively engageable with the objects of the pad disposed around the curved surface, said removal head including:

at least one piston movable between a first position out of contact with the objects and liner of the pad and a second position where the piston contacts the pad and applies a force thereto to securely maintain the position of the objects and liner around the curved surface;

at least one gripper member positioned for engagement with an individual object attached to the liner, and movable between first position away from the curved surface and a second position adjacent an individual object attached to the liner disposed around the curved surface, wherein the gripper member moves from the first to the second position when the piston is in the second position applying a force against the pad to hold the pad in position around the curved surface, the gripper member being pivotable between an open and closed position such that when the gripper member moves to the second position adjacent the individual object, the gripper member is in the open position wherein the gripper member pivots to the closed position to securely engage the individual object attached to the liner at which point the gripper member retracts radially away from the curved surface back to the first position and the gripper member removes the individual object from the liner of the pad with the piston holding the pad in position around the curved surface.

2. The apparatus of claim 1 wherein the curved surface is in the form of a drum with the drum having an outer surface.

3. The apparatus of claim 2 further comprising a conveyor connected to the drum for moving the objects and liner of the pad along the drum such that additional objects of the pad may be removed by the removal head.

4. The apparatus of claim 3 further comprising pinch rollers disposed adjacent the conveyor and drum, said pinch rollers are engageable with the pad as the conveyor advances the pad along the drum such that the pinch rollers forcibly contact the pad between individual objects of the pad to align the objects of the pad with respect to the removal head.

5. The apparatus of claim 2 further comprising at least one pair of opposing side pistons positioned adjacent the outer surface of the drum and extending substantially parallel to the outer surface of the drum for selective engagement with each side of the pad such that the side pistons extend out to securely engage the pad to retain the pad in position around the outer surface of the drum prior to the piston of the removal head moving to the second position in contact with the pad.

6. The apparatus of claim 2 wherein the gripper member includes a pair of opposing arms which are pivotable between the open and closed position for engaging and removing an individual object attached to the liner of the pad.

7. The apparatus of claim 6 wherein the opposing arms of the gripper member each include a contact surface which engages the individual object attached to the liner of the pad when the gripper member pivots to the closed position, said contact surface including a skid-resistant pattern or material.

8. An apparatus for removal of adhesive-backed objects attached to a liner where the objects are arranged in rows on the liner to constitute a pad, comprising:

a drum for receiving the pad of adhesive-backed objects for disposition around the drum, the drum having an outer surface and a radius sufficient to spread the individual objects in adjacent rows apart from one another;

a conveyor connected to the drum for moving the pad along the drum;

a removal head positioned adjacent the drum and selectively engageable with the pad disposed around the drum, said removal head including:

at least one piston movable between a first position out of contact with pad disposed around the drum and a second position where the piston contacts the pad and applies a force thereto to securely maintain the position of the pad around the outer surface of the drum;

a plurality of gripper members positioned for engagement with a plurality of individual objects on a specific row of the pad and movable between first position away from the drum and a second position adjacent individual objects attached to a specific row of the pad, wherein the gripper members move from the first to the second position when the piston is in the second position applying a force against the pad to hold the pad in position around the outer surface of the drum, the gripper members being pivotable between an open and closed position such that when the gripper members move to the second position adjacent the individual objects, the gripper members are in the open position wherein the gripper members pivot to the closed position to securely engage the individual objects attached to the pad at which point the gripper members retract radially away from the drum back to the first position and the gripper members remove the individual objects from the pad with the piston holding the pad in position around the outer surface of the drum;

wherein after removal of individual objects from a row of the pad by the gripper members, the removal head moves to a preselected position away from the drum for dispensing the individual objects by pivoting the gripper members back to the open position and the removal head then returns to the first position adjacent the drum for subsequent removal of individual objects remaining on the row of the pad after which the conveyor moves the pad along the drum so the removal head can access for removal the next row of objects on the pad.

9. A method for removal of adhesive-backed objects attached to a liner with the objects and liner constituting a pad, comprising the steps of:

positioning a pad of adhesive-backed objects around a curved surface;

extending at least one piston against the pad to securely maintain the position of the pad around the curved surface;

grasping an individual adhesive-backed object attached to the liner of the pad with a gripper member to securely retain the object; and retracting the gripper member radially away from the curved surface to remove the individual object from the liner of the pad.

10. The method of claim 9 further comprising the step of:

dispensing the individual adhesive-backed object from the gripper member onto a transfer mechanism for subsequent placement of the adhesive-backed object onto an end product.

11. The method of claim 9 further comprising the step of:

dispensing the individual adhesive-backed object from the gripper member directly onto an end product.

* * * * *